US011640883B2

(12) United States Patent
Weng et al.

(10) Patent No.: US 11,640,883 B2
(45) Date of Patent: May 2, 2023

(54) KEY MODULE

(71) Applicant: Chicony Electronics Co., Ltd., New Taipei (TW)

(72) Inventors: Shin-Chin Weng, New Taipei (TW); Chin-Ping Lin, New Taipei (TW); Shih-Yu Hsu, New Taipei (TW); Chih-Feng Chen, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 17/668,385

(22) Filed: Feb. 10, 2022

(65) Prior Publication Data

US 2022/0293359 A1 Sep. 15, 2022

(30) Foreign Application Priority Data

Mar. 15, 2021 (TW) ..... 110109105

(51) Int. Cl.
*H01H 3/12* (2006.01)
*H01H 13/704* (2006.01)
*H01H 13/7065* (2006.01)

(52) U.S. Cl.
CPC ..... *H01H 13/704* (2013.01); *H01H 3/125* (2013.01); *H01H 13/7065* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS 10,401,970 B1 * 9/2019 Chen ..... H01H 13/705
2022/0262580 A1 * 8/2022 Hou ..... H01H 9/02

FOREIGN PATENT DOCUMENTS

| | | |
|---|---|---|
| TW | M507011 | 8/2015 |
| TW | 201907272 | 2/2019 |
| TW | 201942930 | 11/2019 |

* cited by examiner

*Primary Examiner* — Ahmed M Saeed
(74) *Attorney, Agent, or Firm* — JCIPRNET

(57) ABSTRACT

A key module includes a bracket, a circuit film assembly, a keycap, and a connecting structure. The bracket includes a bottom plate and a bracket pivotal portion protruding from the bottom plate. The circuit film assembly is disposed on the bracket and includes a plurality of film layers and a supporting portion formed by at least one of the film layers. The supporting portion is located beside the bracket pivotal portion. The keycap is disposed above the bracket and the circuit film assembly and includes a keycap pivotal portion. The connecting structure is disposed between the bracket and the keycap and includes a first pivot pivotally disposed at the bracket pivotal portion and a second pivot pivotally disposed at the keycap pivotal portion. The supporting portion beside the bracket pivotal portion supports the first pivot, such that the first pivot continuously contacts the bracket pivotal portion.

2 Claims, 9 Drawing Sheets

KEY MODULE

CROSS-REFERENCE TO RELATED APPLICATION

This application claims the priority benefit of Taiwanese application serial no. 110109105, filed on Mar. 15, 2021. The entirety of the above-mentioned patent application is hereby incorporated by reference herein and made a part of this specification.

BACKGROUND

Technical Field

The disclosure relates to a key module, and in particular, relates to a key module which may not produce noise easily and may not wobble easily.

Description of Related Art

At present, in a key module, since a gap is provided between the pivots of the scissor structure and the bracket pivotal portion due to the presence of tolerance, the key module may wobble easily. Besides, when the keycap is pressed, the pivots of the scissor structure may hit the bracket pivotal portion, and noise is thereby produced.

SUMMARY

The disclosure provides a key module which may not produce noise easily and may not wobble easily.

The disclosure provides a key module including a bracket, a circuit film assembly, a keycap, and a connecting structure. The bracket includes a bottom plate and a bracket pivotal portion protruding from the bottom plate. The circuit film assembly is disposed on the bracket and includes a plurality of film layers and a supporting portion formed by at least one of the film layers. The supporting portion is located beside the bracket pivotal portion. The keycap is disposed above the bracket and the circuit film assembly and includes a keycap pivotal portion. The connecting structure is disposed between the bracket and the keycap and includes a first pivot and a second pivot. The first pivot is pivotally disposed at the bracket pivotal portion, and the second pivot is pivotally disposed at the keycap pivotal portion. The supporting portion beside the bracket pivotal portion supports the first pivot, such that the first pivot continuously contacts the bracket pivotal portion.

In an embodiment of the disclosure, a space is formed at one side of the supporting portion away from the keycap, and the supporting portion supporting the first pivot is adapted to be deformed towards the space.

In an embodiment of the disclosure, the film layers include three film layers stacked in sequence. the middle one of the three film layers has a hole located beside the bracket pivotal portion, and the space is formed by the hole. The supporting portion is formed on the one of the film layers furthest away from the bottom plate.

In an embodiment of the disclosure, at least one of the film layers closer to the bottom plate has at least one hole located beside the bracket pivotal portion. The space is formed by the at least one hole located between the supporting portion and the bottom plate.

In an embodiment of the disclosure, a number of the at least one of the film layers closer to the bottom plate body is multiple. The at least one hole is a plurality of holes connected up and down. The space is formed by the holes located between the supporting portion and the bottom plate. The supporting portion is formed on the one of the film layers furthest away from the bottom plate.

In an embodiment of the disclosure, the number of the at least one of the film layers closer to the bottom plate body is multiple. The at least one hole is one hole. The space is formed by the hole located between the supporting portion and the bottom plate. The supporting portion is formed on the film layers away from the bottom plate.

In an embodiment of the disclosure, the film layers include three film layers stacked in sequence. The one among the three film layers closest to the bottom plate has a lower hole located beside the bracket pivotal portion. The one among the three film layers furthest away from to the bottom plate has an upper hole located beside the bracket pivotal portion. The space is formed by the lower hole located between the supporting portion and the bottom plate, and the supporting portion is formed on the middle one among the three film layers.

In an embodiment of the disclosure, the bottom plate includes a bracket hole located beside the bracket pivotal portion. The space is formed by the bracket hole, and the supporting portion covers the bracket hole.

In an embodiment of the disclosure, portions of the film layers located beside the bracket pivotal portion form the supporting portion together.

In an embodiment of the disclosure, adjacent two sides of the supporting portion are suspended.

In an embodiment of the disclosure, the keycap includes a keycap pivotal portion. the connecting structure includes a second pivot pivotally disposed at the keycap pivotal portion.

To sum up, in a key module provided by the related art, since a gap is provided between the pivots of the connecting structure and the bracket pivotal portion, the keycap may produce noise easily when being pressed. Compared to the related art, in the key module provided by the disclosure, since at least one of the film layers of the circuit film assembly extends to the side of the bracket pivotal portion to form the supporting portion supporting the first pivots, the first pivots may be supported upwardly and thus may continuously contact the bracket pivotal portion. In this way, a gap may not be provided between the first pivots and the bracket pivotal portion, the keycap therefore may not produce noise easily when being pressed, and the first pivots may be pivotally disposed at the bracket pivotal portion stably without wobbling easily.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
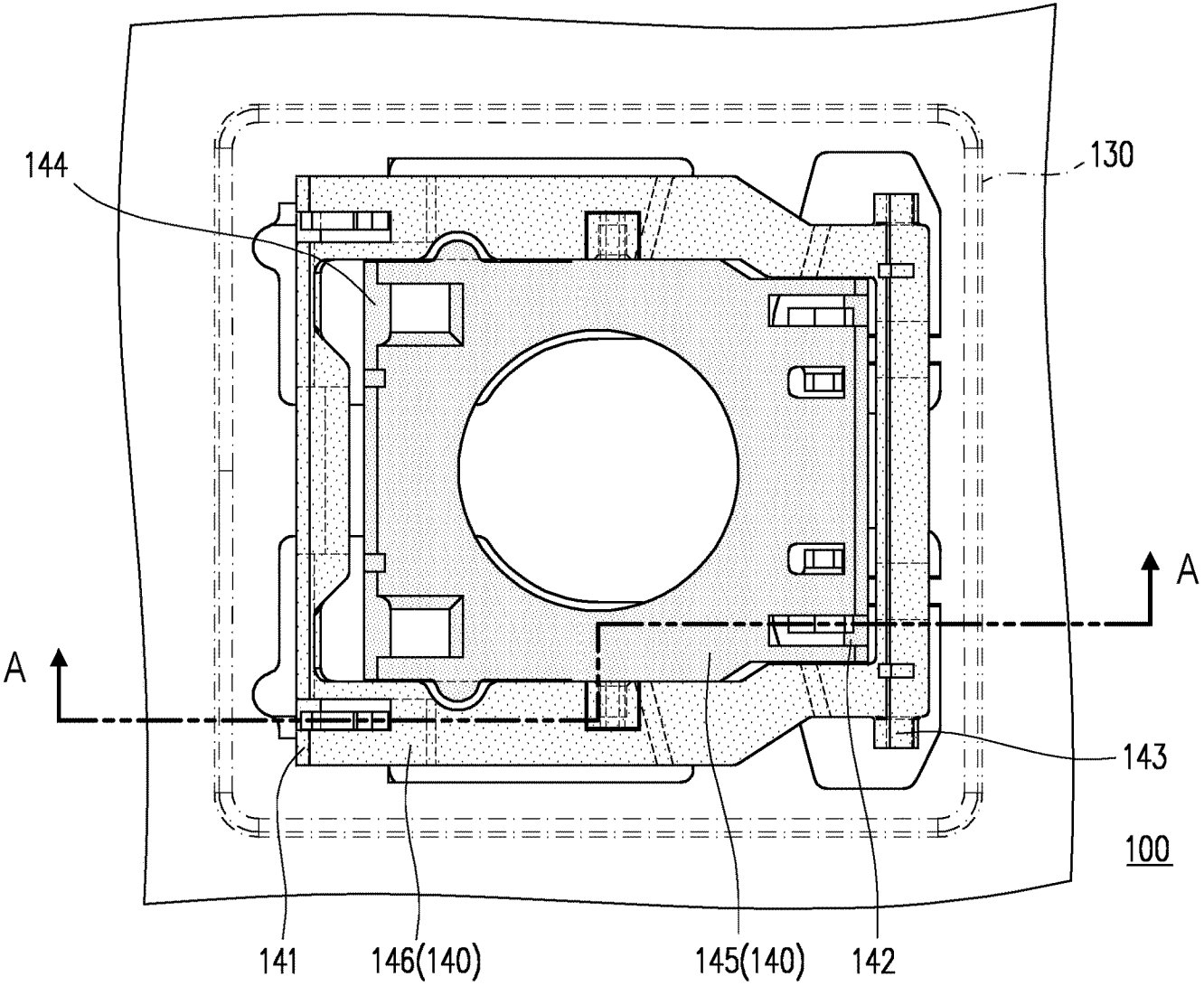
FIG. 1 is a top schematic view of a key module according to an embodiment of the disclosure.
Figure 2:
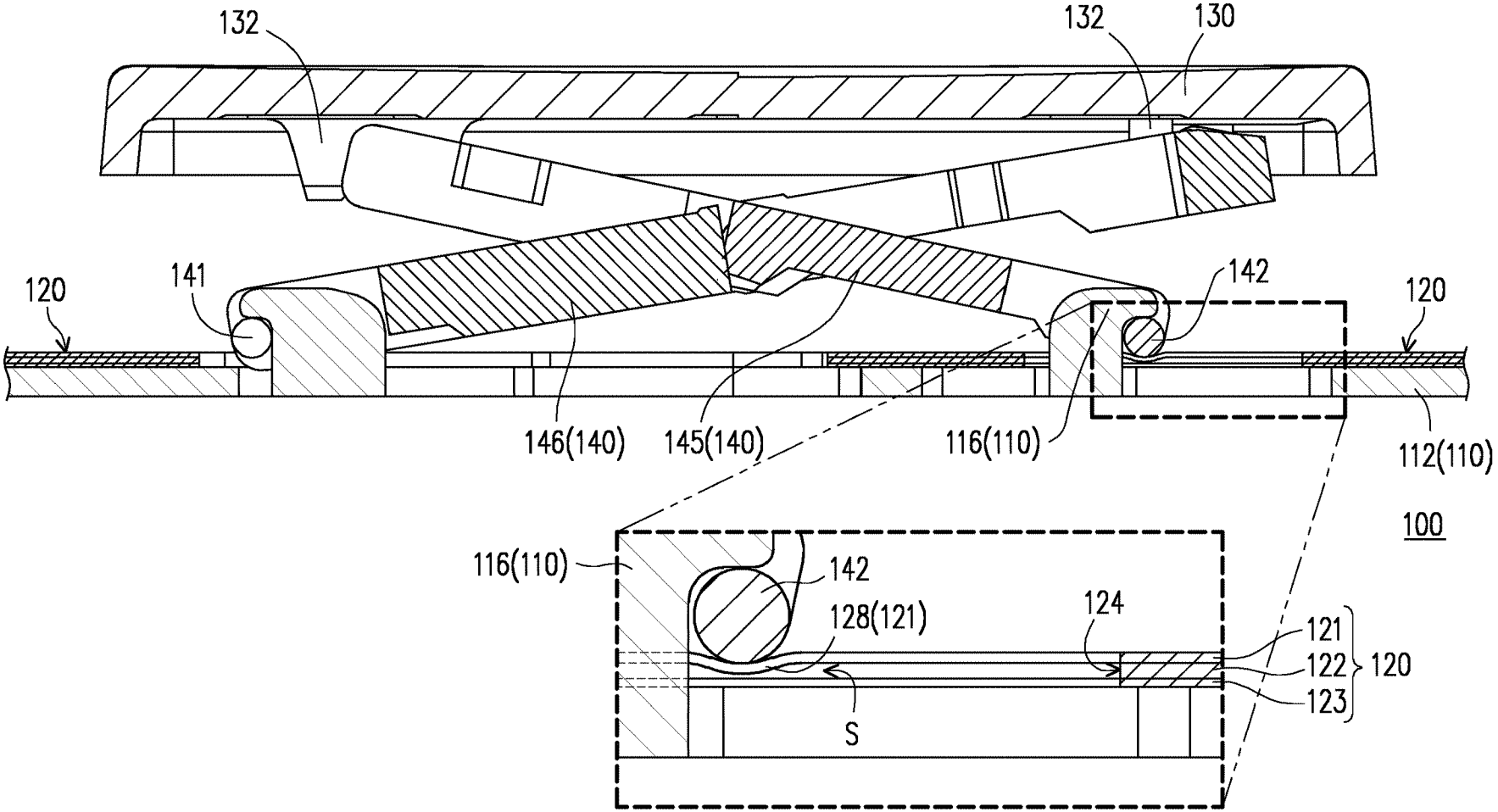
FIG. 2 is a cross-sectional schematic view of the key module of FIG. 1 taken along a line segment A-A.
Figure 3:
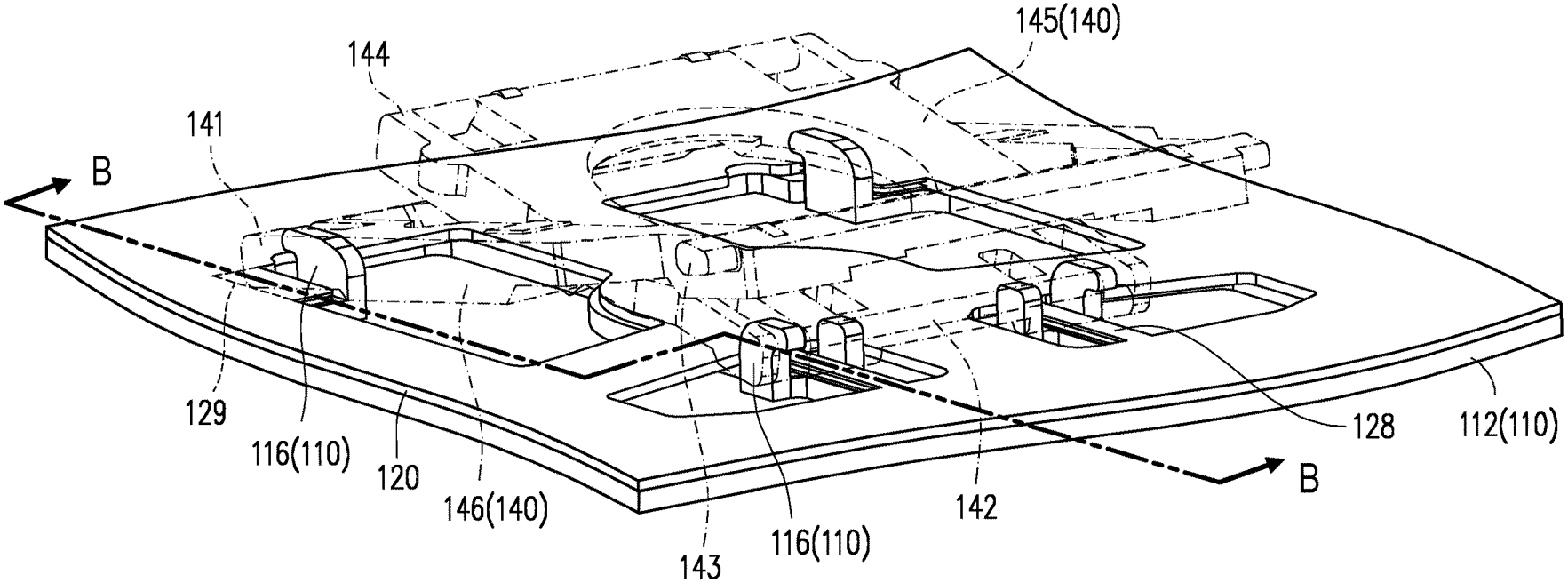
FIG. 3 is a three-dimensional schematic view of FIG. 1 with a keycap being hidden.

FIG. 1 is a top schematic view of a key module according to an embodiment of the disclosure. FIG. 2 is a cross-sectional schematic view of the key module of FIG. 1 taken along a line segment A-A. FIG. 3 is a three-dimensional schematic view of FIG. 1 with a keycap being hidden. Note that the line segment A-A in FIG. 1 passes through pivots and a bracket pivotal portion between a connecting structure and a bottom plate, such that a corresponding cross-sectional view is shown in FIG. 2.

With reference to FIG. 1 to FIG. 3, a key module 100 provided by this embodiment may be applied to a keyboard, but the types of products to which the key module 100 applied are not limited thereto. As shown in FIG. 2, the key module 100 includes a bracket 110, a circuit film assembly 120, a keycap 130, and a connecting structure 140.

The bracket 110 includes a bottom plate 112 and a bracket pivotal portion 116 protruding from the bottom plate 112. The circuit film assembly 120 is disposed on the bracket 110 and includes a plurality of film layers 121, 122, and 123 stacked in sequence. In this embodiment, a circuit (not shown) may be provided among the film layers 121, 122, and 123 of the circuit film assembly 120. A material of the film layers 121, 122, and 123 is, for example, PET, but the number and material of the film layers 121, 122, and 123 are not limited thereto. In other embodiments, the number of the film layers may also be a single layer or multiple layers.

Besides, as shown in FIG. 3, the circuit film assembly 120 further includes supporting portions 128 and 129 formed by at least one of the film layers 121, 122, and 123. In this embodiment, the supporting portions 128 and 129 are located beside the bracket pivotal portion 116.

Figure 4:
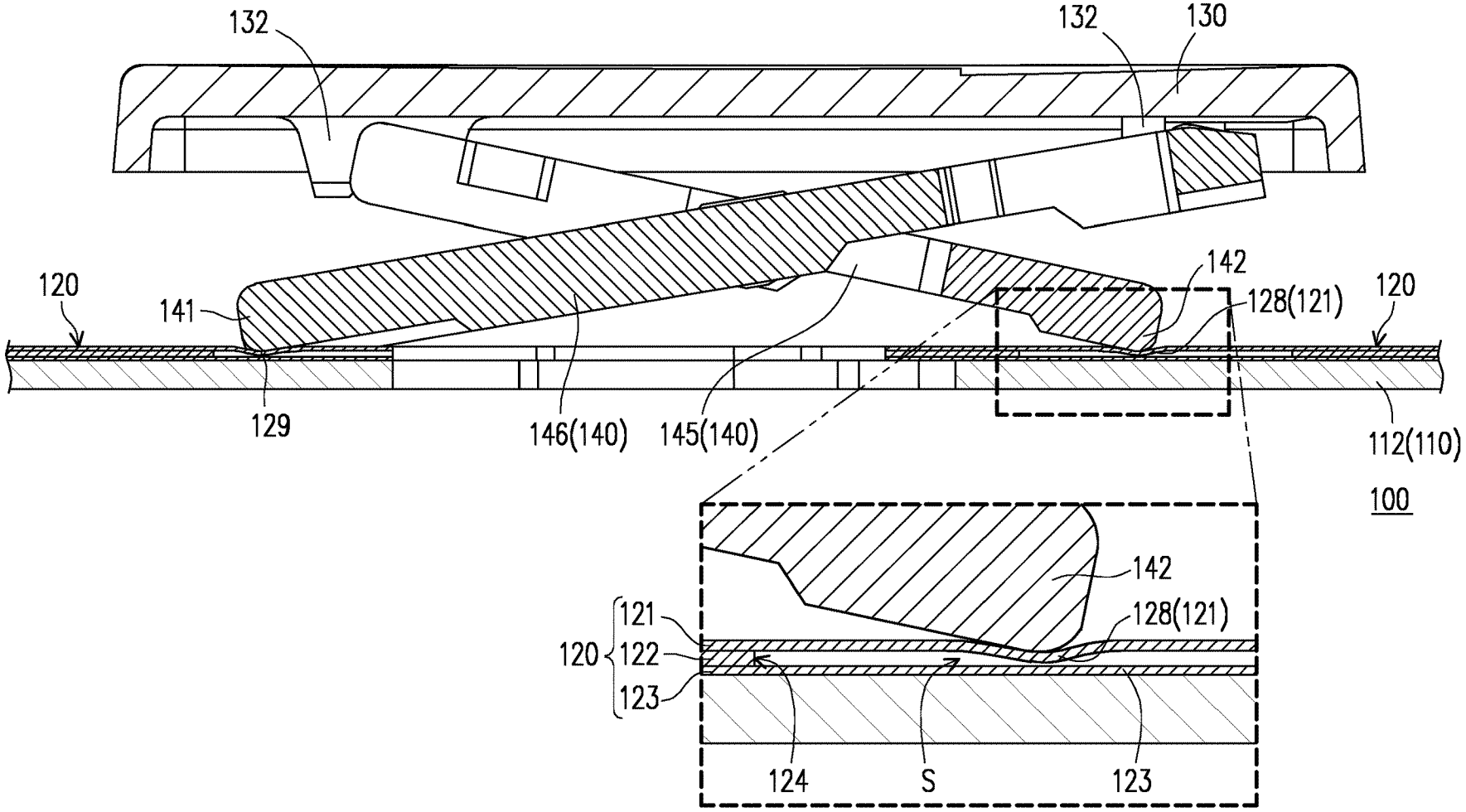
FIG. 4 is a cross-sectional schematic view of the key module of FIG. 1 taken along a line segment B-B in FIG. 3.

FIG. 4 is a cross-sectional schematic view of the key module of FIG. 1 taken along a line segment B-B in FIG. 3. Note that the line segment B-B in FIG. 3 passes through the supporting portions 128 and 129, such that a corresponding cross-sectional view is shown in FIG. 4. With reference to FIG. 4, in this embodiment, the supporting portions 128 and 129 are formed by the uppermost film layer 121.

The keycap 130 is disposed above the bracket 110 and the circuit film assembly 120, and the keycap 130 includes a keycap pivotal portion 132. In an embodiment, an elastic body (not shown) may be disposed between the keycap 130 and the circuit film assembly 120 to provide a rising restoration force after the keycap 130 is pressed down. The elastic body is, for example, a rubber dome, but the material and shape of the elastic body are not limited thereto.

The connecting structure 140 is, for example, a scissor structure formed by an inner scissor 145 and an outer scissor 146, and the connecting structure 140 is disposed between the bracket 110 and the keycap 130. With reference to FIG. 3 again, the outer scissor 146 of the connecting structure 140 includes a first pivot 141 and a second pivot 143. The inner scissor 145 of the connecting structure 140 includes a first pivot 142 and a second pivot 144. The first pivots 141 and 142 are pivotally disposed at the bracket pivotal portion 116, and the second pivots 143 and 144 are pivotally disposed at the keycap pivotal portion 132 (see FIG. 2).

In a conventional key, the pivots of the connecting structure usually contact the bracket pivotal portion and the bottom plate directly. Since a tolerance is provided between the pivots of the connecting structure and the bracket pivotal portion in such a conventional key, a gap is provided between the pivots of the connecting structure and the bracket pivotal portion. As such, when the keycap is pressed, the pivots of the connecting structure may hit the bracket pivotal portion or the bottom plate, and noise is thereby produced.

In this embodiment, in order to prevent a gap from being formed between the first pivots 141 and 142 and the bracket pivotal portion 116, as shown in FIG. 3, in the key module 100, the film layer 121 of the circuit film assembly 120 extends to a side of the bracket pivotal portion 116, is located below the first pivots 141 and 142, and thereby acts as the supporting portions 129 and 128 capable of supporting the first pivots 141 and 142 in this embodiment.

It can be seen from FIG. 2 that a top surface of a portion of the film layer 121 away from the bracket pivotal portion 116 is higher than bottom ends of the first pivots 141 and 142. As such, when a portion of the film layer 121 located beside the bracket pivotal portion 116 is treated as the supporting portions 128 and 129 (shown in FIG. 3) supporting the first pivots 141 and 142, the supporting portions 128 and 129 may be supported upwardly by the portion of the film layer 121 away from the bracket pivotal portion 116, and the first pivot 142 is thereby supported upwardly by the supporting portions 128 and 129. Accordingly, the first pivots 141 and 142 may continuously and completely contact the bracket pivotal portion 116.

In this way, a gap may not be provided between the first pivots 141 and 142 and the bracket pivotal portion 116, and that the first pivots 141 and 142 may pivotally disposed at the bracket pivotal portion 116 stably without wobbling easily. In addition, when the keycap 130 is pressed, since the first pivots 141 and 142 may not hit the bracket pivotal portion 116 nor contact the bottom plate 112, the keycap 130 may not produce noise easily when being pressed.

As shown in FIG. 4, in this embodiment, the supporting portions 128 and 129 are formed on the film layer 121 furthest away from the bottom plate 112, and the supporting portions 128 and 129 are suspended. A space S is formed on a side (lower side) of the supporting portions 128 and 129 away from the keycap 130. Since the top surface of the film layer 121 acting as the supporting portions 128 and 129 is originally higher than the bottom end of the first pivot 142, when the supporting portions 128 and 129 support the first pivot 142, the flexible supporting portions 128 and 129 are slightly deformed. The space S below the supporting portions 128 and 129 may be treated as a space for deformation generated by the supporting portions 128 and 129.

Specifically, in this embodiment, the film layer 122 located in the center has a hole 124 located beside the bracket pivotal portion 116. The hole 124 located between the supporting portions 128 and 129 and the film layer 123 acts as the space S that the supporting portions 128 and 129 may enter. Certainly, forms of the supporting portions 128 and 129 and the space S are not limited to the above.

Figure 5:
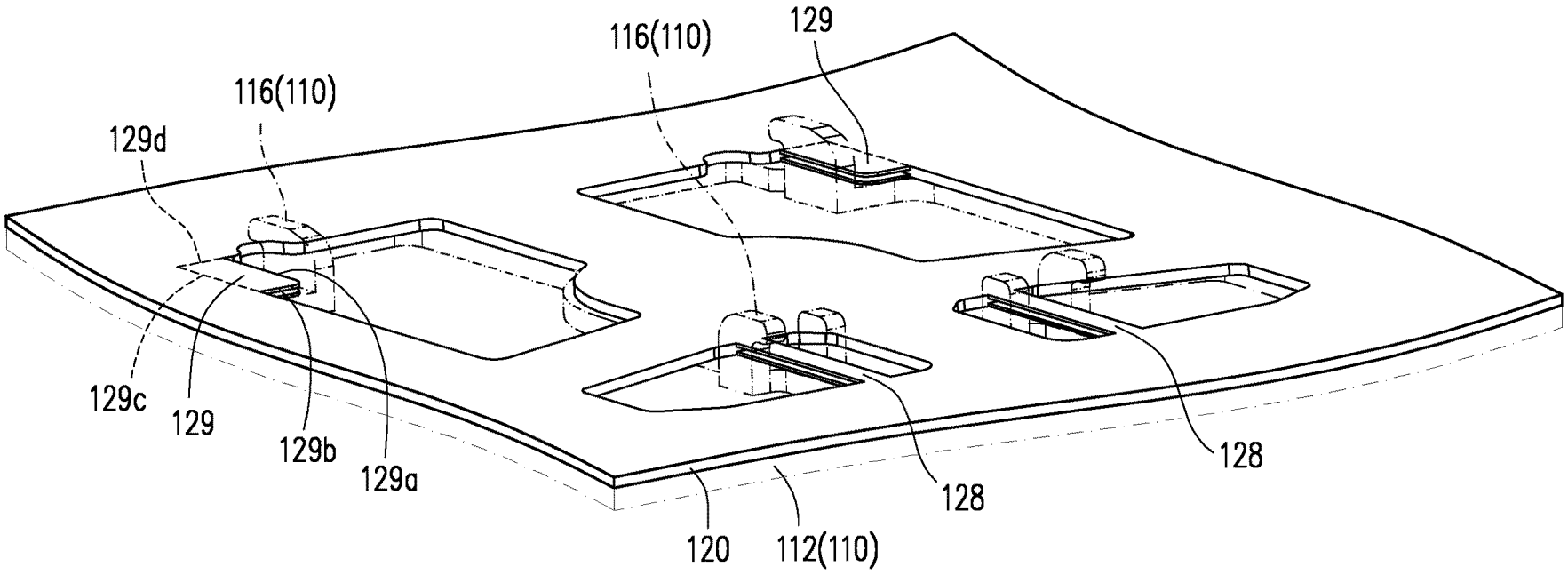
FIG. 5 is a local three-dimensional schematic view of FIG. 3 with a connecting structure being hidden.

FIG. 5 is a local three-dimensional schematic view of FIG. 3 with a connecting structure being hidden. With reference to FIG. 5, in this embodiment, the form of the supporting portion 128 and the form of the supporting portion 129 are slightly different. Two adjacent sides 129*a* and 129*b* of the supporting portion 129 are suspended, and the other adjacent two sides 129*c* and 129*d* are the sides extending from the uppermost film layer. Compared with the supporting portion 128 whose opposite sides are the sides that are suspended, in this embodiment, the design of suspension of the two adjacent sides 129*a* and 129*b* for the supporting portion 129 allows the supporting portion 129 to have a greater degree of flexure without damaging its structure.

Certainly, in other embodiments, the key module may have only the supporting portion 128 having suspended two opposite sides or may have only the supporting portion 129 having the suspended two adjacent sides 129*a* and 129*b*, and the form of the key module is not limited thereto.

The following introduces key modules with other forms of supporting portions, and elements identical or similar to those provided in the previous embodiments are represented by the same or similar reference numerals, description thereof is not repeated herein, and only the main differences are described.

Figure 6:
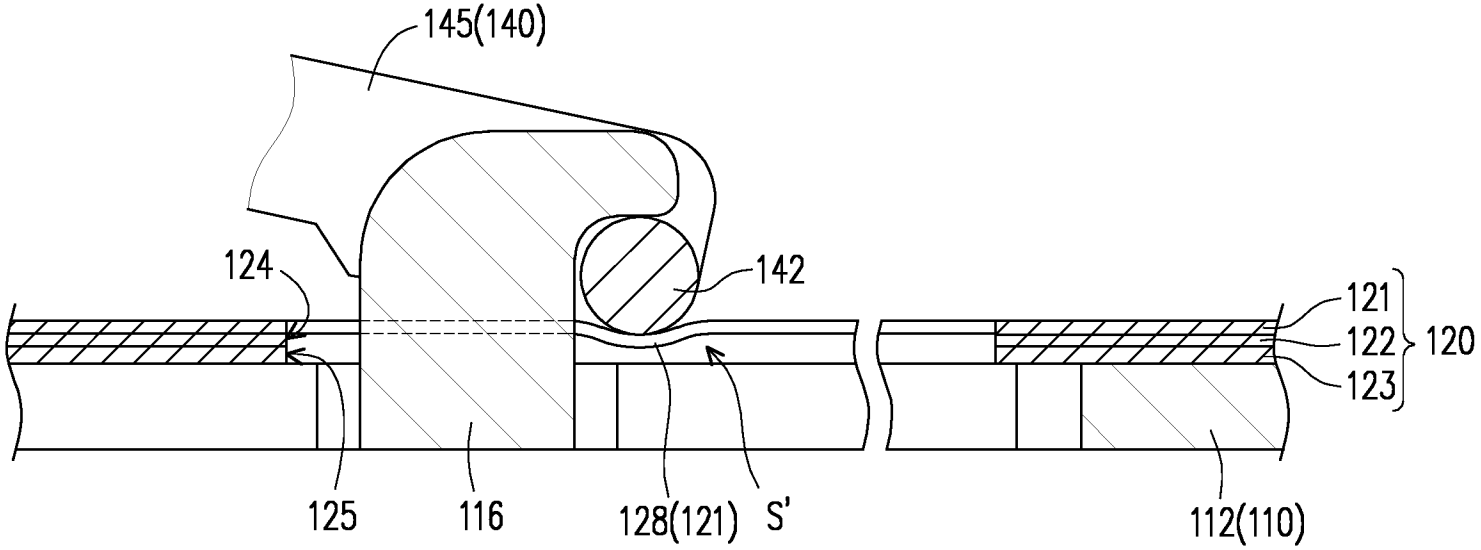
FIG. 6 to FIG. 9 are local cross-sectional schematic views of a plurality types of key modules according to other embodiments of the disclosure.

FIG. 6 to FIG. 9 are local cross-sectional schematic views of a plurality types of key modules according to other embodiments of the disclosure. With reference to FIG. 6 first, the main difference between FIG. 6 and the enlarged view in FIG. 2 is that: in this embodiment, the film layer 123 closest to the bottom plate 112 further includes a hole 125 located beside the bracket pivotal portion 116, and the hole 124 of the film layer 122 and the hole 125 of the film layer 123 are connected up and down. A space S' that may allow the supporting portion 128 to enter is formed by the two holes 124 and 125 located between the supporting portion 128 and the bottom plate 112 together. Such a design may provide a larger space S' for the supporting portion 128 to flex.

Similarly, the original top surface of the uppermost film layer 121 is higher than the bottom end of the first pivot 142. As such, when the film layer 121 acts as a supporting portion 128*a* supporting the first pivot 142, the first pivot 142 may be supported upwardly and thus may continuously contact the bracket pivotal portion 116. Further, the space S' below the supporting portion 128 may be treated as a space provided for the supporting portion 128 to be deformed. In this way, the first pivot 142 and the bracket pivotal portion 116 may completely contact each other without a gap being provided therebetween, the first pivot 142 may not contact the bottom plate 112, and a key thereby may not produce noise easily when being used. Moreover, the first pivot 142 may be pivotally disposed at the bracket pivotal portion 116 stably, so that the keycap 130 (FIG. 2) may not wobble easily.

Figure 7:
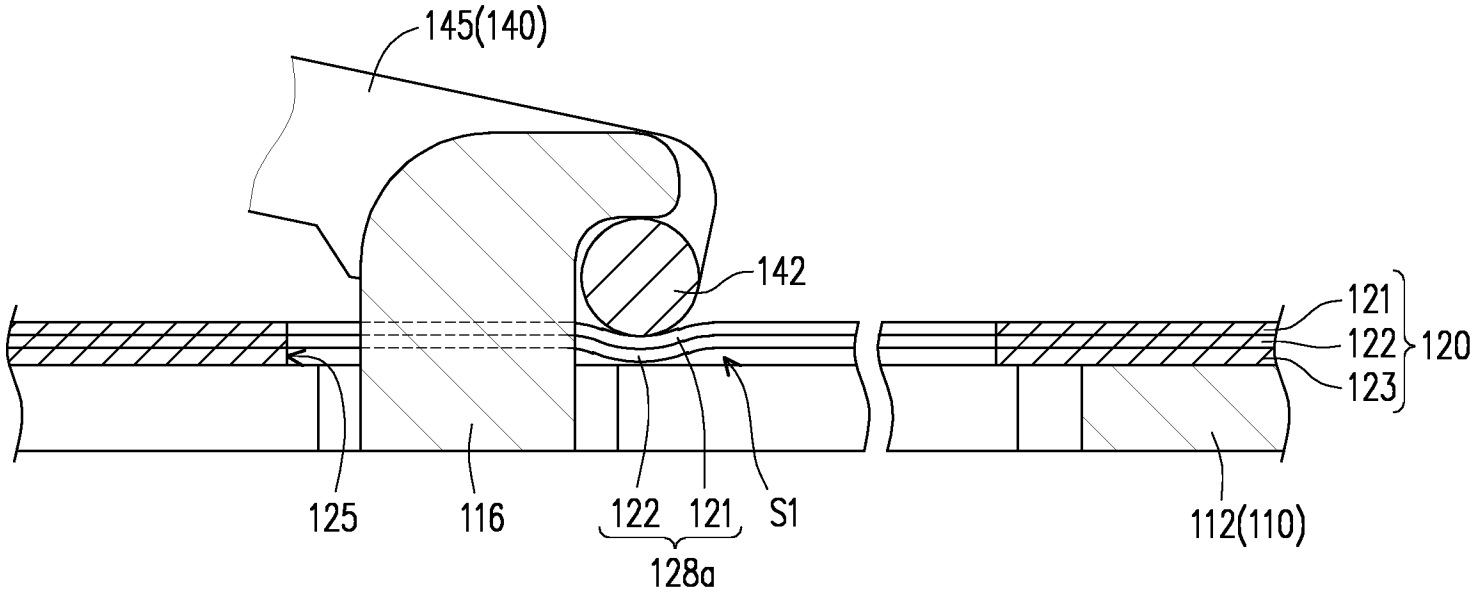

With reference to FIG. 7, the main difference between FIG. 7 and the enlarged view in FIG. 2 is that: in this embodiment, the supporting portion 128*a* is formed on the film layers 121 and 122 away from the bottom plate 112, the film layer 123 close to the bottom plate 112 is provided with the hole 125, and a space S1 is formed by the hole 125 between the supporting portion 128*a* and the bottom plate 112.

Similarly, the original top surface of the uppermost film layer 121 is higher than the bottom end of the first pivot 142. As such, when the two film layers 121 and 122 located above act as the supporting portion 128*a* supporting the first pivot 142, the first pivot 142 may be supported upwardly and thus may continuously contact the bracket pivotal portion 116. Further, the space S1 below the supporting portion 128*a* may be treated as a space provided for the supporting portion 128*a* to be deformed. In this way, the first pivot 142 and the bracket pivotal portion 116 may not be provided with a gap therebetween, the first pivot 142 may not contact the bottom plate 112, and a key thereby may not produce noise easily when being used. Moreover, the first pivot 142 may be pivotally disposed at the bracket pivotal portion 116 stably, so that the keycap 130 (FIG. 2) may not wobble easily.

Figure 8:
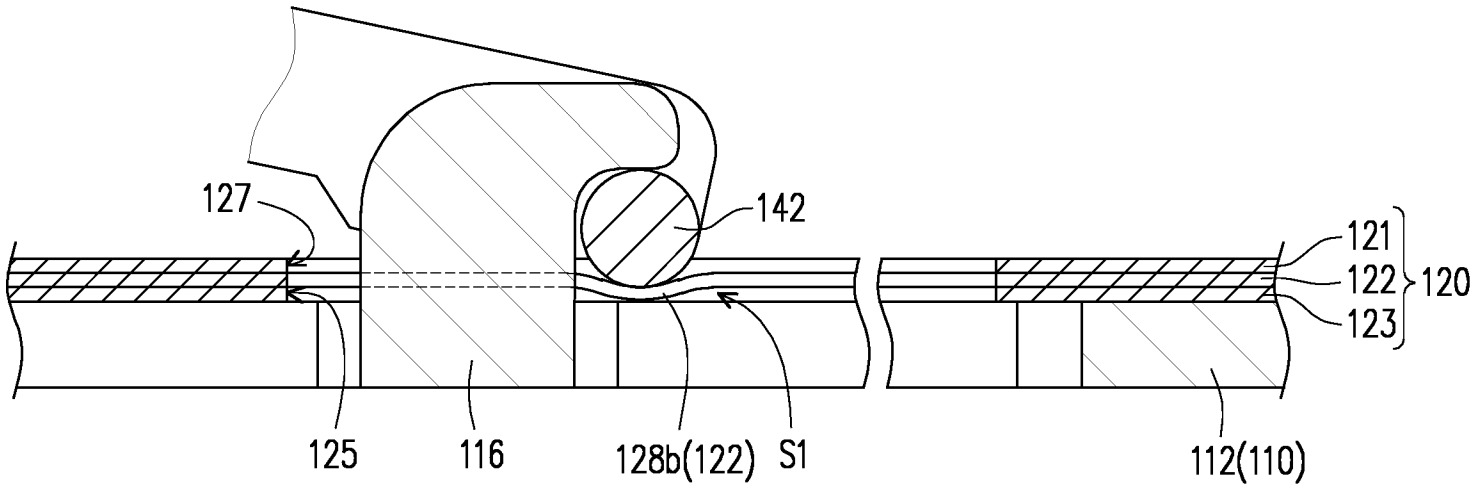

With reference to FIG. 8, the main difference between FIG. 8 and the enlarged view in FIG. 2 is that: in this embodiment, the film layer 123 closest to the bottom plate 112 has the hole 125 (lower hole) located beside the bracket pivotal portion 116, and the film layer 121 furthest away from the bottom plate 112 has an upper hole 127 located beside the bracket pivoting portion 116. A supporting portion 128*b* is formed on the film layer 122 located in the middle, and the space S1 is formed by the hole 125 (lower hole) between the supporting portion 128*b* and the bottom plate 112.

Similarly, the original top surface of the middle film layer 122 is higher than the bottom end of the first pivot 142. As such, when the middle film layer 122 acts as the supporting portion 128*b* supporting the first pivot 142, the first pivot 142 may be supported upwardly and thus may continuously contact the bracket pivotal portion 116. Further, the space S1 below the supporting portion 128*b* may be treated as a space provided for the supporting portion 128*b* to be deformed. In this way, the first pivot 142 and the bracket pivotal portion 116 may not be provided with a gap therebetween, the first pivot 142 may not contact the bottom plate 112, and a key thereby may not produce noise easily when being pressed. Moreover, the first pivot 142 may be pivotally disposed at the bracket pivotal portion 116 stably, so that the keycap 130 (FIG. 2) may not wobble easily.

Figure 9:
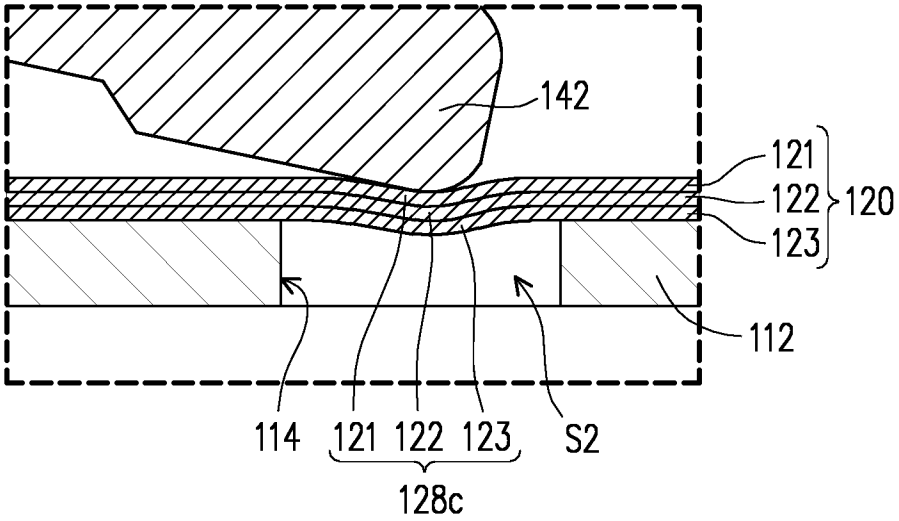

With reference to FIG. 9, the main difference between FIG. 9 and the enlarged view in FIG. 4 is that: in FIG. 4, the supporting portion 128 is formed by the film layer 121, the space S is formed by the hole 124 of the film layer 122, and the bottom plate 112 located below the supporting portion 128 is not provided with a hole.

In this embodiment, as shown in FIG. 9, portions of these film layers 121, 122, and 123 located beside the bracket pivotal portion 116 form a supporting portion 128*c* together. The bottom plate 112 includes a bracket hole 114 located beside the bracket pivotal portion 116, and the supporting portion 128*c* covers the bracket hole 114. A space S2 is formed by the bracket hole 114. That is, the bracket hole 114 provides a space for the supporting portion 128*c* to be deform. Therefore, as shown in FIG. 9, the supporting portion 128*c* formed by the film layers 121, 122, and 123 may be slightly deformed towards the bracket hole 114 when supporting the first pivot 142.

Similarly, the original top surface of the middle film layer 121 among the film layers 121, 122, and 123 is higher than the bottom end of the first pivot 142. As such, when the film layers 121, 122, and 123 act as the supporting portion 128*c* supporting the first pivot 142, the first pivot 142 may be supported upwardly and thus may continuously contact the bracket pivotal portion 116. Further, the space S2 below the supporting portion 128*c* may be treated as a space provided for the supporting portion 128*c* to be deformed. In this way, the first pivot 142 and the bracket pivotal portion 116 may not be provided with a gap therebetween, the first pivot 142 may not contact the bottom plate 112, and a key thereby may not produce noise easily when being used. Moreover, the first pivot 142 may be pivotally disposed at the bracket pivotal portion 116 stably, so that the keycap 130 (FIG. 2) may not wobble easily.

In view of the foregoing, in a key module provided by the related art, since a gap is provided between the pivots of the connecting structure and the bracket pivotal portion, the keycap may produce noise easily when being pressed.

Compared to the related art, in the key module provided by the disclosure, since at least one of the film layers of the circuit film assembly extends to the side of the bracket pivotal portion to form the supporting portion supporting the first pivots, the first pivots may be supported upwardly and thus may continuously contact the bracket pivotal portion. In this way, a gap may not be provided between the first pivots and the bracket pivotal portion, the keycap therefore may not produce noise easily when being pressed, and the first pivots may be pivotally disposed at the bracket pivotal portion stably without wobbling easily.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A key module, comprising:

a bracket, comprising a bottom plate and a bracket pivotal portion protruding from the bottom plate, a circuit film assembly, disposed on the bracket, comprising a plurality of film layers and a supporting portion formed by at least one of the film layers, wherein the supporting portion is located beside the bracket pivotal portion; a keycap, disposed above the bracket and the circuit film assembly, comprising a keycap pivotal portion; and a connecting structure, disposed between the bracket and the keycap, comprising a first pivot and a second pivot, wherein the first pivot is pivotally disposed at the bracket pivotal portion, the second pivot is pivotally disposed at the keycap pivotal portion, and the supporting portion beside the bracket pivotal portion supports the first pivot, such that the first pivot continuously contacts the bracket pivotal portion, wherein a space is formed at one side of the supporting portion away from the keycap, and the supporting portion supporting the first pivot is adapted to be deformed towards the space, wherein the film layers comprise a first film layer, a second film layer, and a third film layer stacked in sequence, the second film layer has a hole located beside the bracket pivotal portion, the space is formed by the hole, and the supporting portion is formed on the first film layer furthest away from the bottom plate, and the third film layer is disposed between the supporting portion formed on the first film layer and the bottom plate, as to provide further cushioning and avoid noise from being generated when the supporting portion is deformed toward the bottom plate.

2. The key module according to claim 1, wherein adjacent two sides of the supporting portion are suspended.

* * * * *